United States Patent [19]

White

[11] Patent Number: 4,779,678

[45] Date of Patent: Oct. 25, 1988

[54] SUCKER ROD GUIDE

[76] Inventor: Richard C. White, 1704 N. Maplewood, Tulsa, Okla. 74115

[21] Appl. No.: 606,178

[22] Filed: May 2, 1984

[51] Int. Cl.[4] ..... E21B 17/10

[52] U.S. Cl. ..... 166/241

[58] Field of Search ..... 166/241; 308/4 A, 6 A

[56] References Cited

U.S. PATENT DOCUMENTS

| | | | |
|---|---|---|---|
| 712,488 | 11/1902 | Black | 308/6 A |
| 735,200 | 8/1908 | Black | 308/6 A |
| 2,198,720 | 4/1940 | Edgecomb et al. | 308/6 A |
| 2,601,478 | 6/1952 | Weir | 308/6 A |
| 2,964,110 | 12/1960 | Garwood et al. | 166/241 |
| 3,995,479 | 12/1976 | Chapman, III | 308/6 A |

*Primary Examiner*—Jerome W. Massie
*Assistant Examiner*—William P. Neuder
*Attorney, Agent, or Firm*—Head & Johnson

[57] ABSTRACT

A sucker rod guide for use in a string of sucker rods reciprocated in tubing, the guide being formed of an elongated cylindrical member having female threaded recesses at the upper and lower ends for attachment to sucker rods and having a plurality of spaced apart parallel sided slots extending through the member in planes of the cylindrical axis, each slot having two wheels rotatably mounted therein on opposite sides of the tubular axis, the wheels being of a diameter less than the diameter of the member and being positioned to contact the interior wall of tubing on opposite sides of the member. The rotational position of adjacent slots are displaced so that the member includes sufficient wheels to keep the body of the member out of contact with tubing and thereby reduce the possibility of the sucker rods sliding against the interior tubing wall.

2 Claims, 2 Drawing Sheets

SUCKER ROD GUIDE

SUMMARY OF THE INVENTION

After an oil well is drilled it may flow for a period due to gas pressure in the producing formation. Most wells however eventually loose gas pressure and it is necessary to pump the crude oil, along with any comingled water, to the earth's surface. The most common means of pumping oil wells is by the use of a string of elongated steel sucker rods which are reciprocated in a string of tubing extending from the earth's surface down to the producing formation. At the lower end of the string of sucker rods is a reciprocated pump. The sucker rods are reciprocated by a pumping unit at the earth's surface. If the borehole which forms the producing well is perfectly vertical and straight, and if the sucker rods are always under tension, then no appreciable friction exists between the sucker rods and the tubing. However, these conditions are rare. Most boreholes are crooked and, in addition, are not perfectly vertical but tend to drift off in one direction or another from the vertical. The reason for this is that it is virtually impossible to precisely control the direction of a drill bit from the earth's surface. Due to varying structural densities and inclination of substructures relative to the horizontal, drill bits tend to drift from the vertical during drilling operations. Therefore, most wells have tubing strings which are not straight and not perfectly vertical and in these wells the sucker rods tend to rub against the side wall of the tubing.

When a sucker rod rubs against a tubing sidewall as it is reciprocated, several things occur which are bad for the well operator. First, it takes more energy to reciprocate a string of sucker rods if they rub against the interior wall of the tubing. Second, the frictional engagement wears out the sucker rods and third, it wears out the tubing. If a hole is worn into a tubing the production fluid will leak out and if the hole becomes of any significant size the tubing string has to be pulled and replaced. For these reasons, it is highly desireable that provisions be made to provide anti-friction devices in sucker rod strings.

Others have suggested such devices; examples of which may be had by referring to the following U.S. Pat. Nos.: 467,494; 484,947; 712,901; 1,517,027; 1,566,451; 1,699,087; 1,877,395; 1,893,020; 1,913,365; 1,923,328; 2,058,331; 2,198,720; and 2,601,478. Perhaps the patent exemplifying the state of the art to which the present invention applies is U.S. Pat. No. 2,198,720 issued to Edgecomb et al. This patent shows an elongated cylindrical device for attachment at its upper and lower end to a string of sucker rods. The device has slots in the sidewalls with relatively large diameter wheels. There is one wheel in each slot. When the diameter of the wheel is less than the internal diameter of the tubing, the wheel is positioned to engage the tubing wall. Slots are positioned at various elevations on the member with the slots rotatably positioned so that they are out of alignment.

One problem with the device of Edgecomb et al is that the wheels are of a diameter greater than the diameter of the member and extend beyond the opposed side walls of the member. If the total diameter of each wheel is less than the internal diameter of the tubing theoretically, the wheel cannot touch the opposed internal walls of the tubing simultaneously. However, tubing tends to develop encrustations, paraffin, corrosion and so forth so that the interior diameter of tubing may be significantly less than the nominal diameter when the tubing is first installed. This can cause the wheels in the Edgecomb et al device to simultaneously engage the opposed side walls of the interior of the tubing. When this happens, the wheel will either be prohibiting from rotating or, if it rotates in one direction it will cause substantial wear on the wheel since it will be simultaneously sliding against the opposed side wall.

The present invention utilizes the advantageous aspects of the Edgecomb et al device but in an arrangement which prevents the possibility of a wheel from being excessively worn by simultaneously contacting opposed sides of the tubing side wall, irrespective of how the internal diameter of the tubing may be reduced by encrustation. In the present invention the sucker rod guide is of an elongated cylindrical member as in Edgecomb et al with means at the upper and lower end for attachment in a string of sucker rods. A plurality of spaced apart slots are formed in the member. The member includes two wheels in each slot, each of the wheels being of a diameter less than the diameter of the member so that as to each wheel, only a portion of the peripherial edge extends externally of the member. The wheels are supported on axii which are parallel to each other but spaced on opposite sides of a plane of the member cylindrical axis. The axii may be slightly elevationally offset relative to each other. The planes of adjacent slots are offset so that the entire guide is held away from the wall of the tubing in which it is used.

Since a wheel cannot engage simultaneously the opposed walls of the tubing they are not subject to rapid wear as in the prior art devices.

DETAILED DESCRIPTION OF THE PREFERRED EMBODIMENTS

Figure 2:
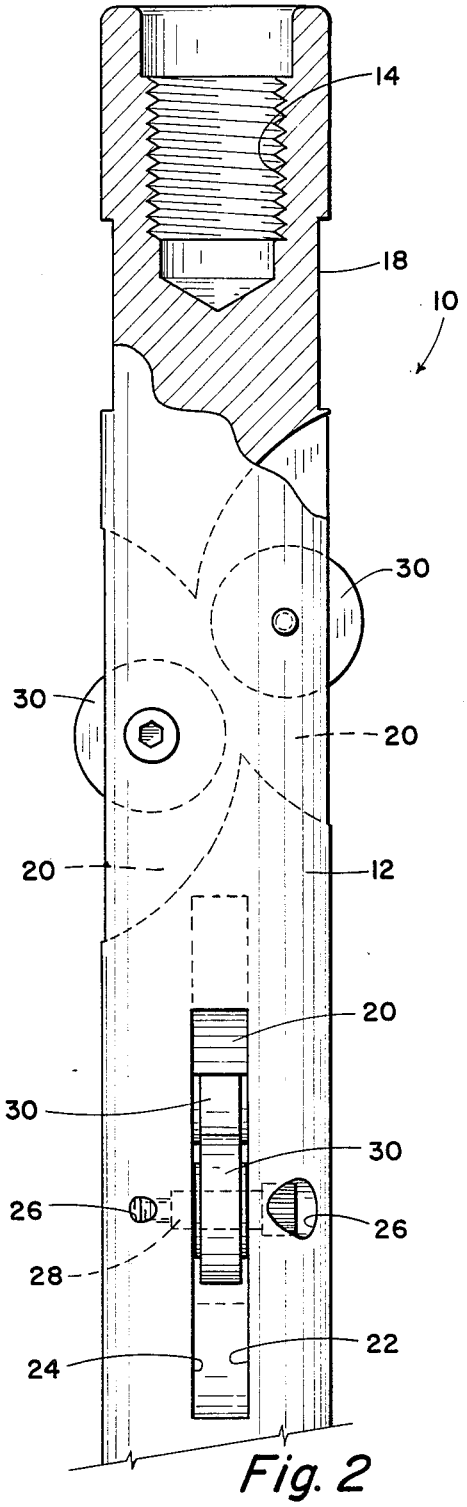
FIG. 2 is an enlarged partial elevational view taken along the line 2—2 of FIG. 1 showing more details of the device.
Figure 1:
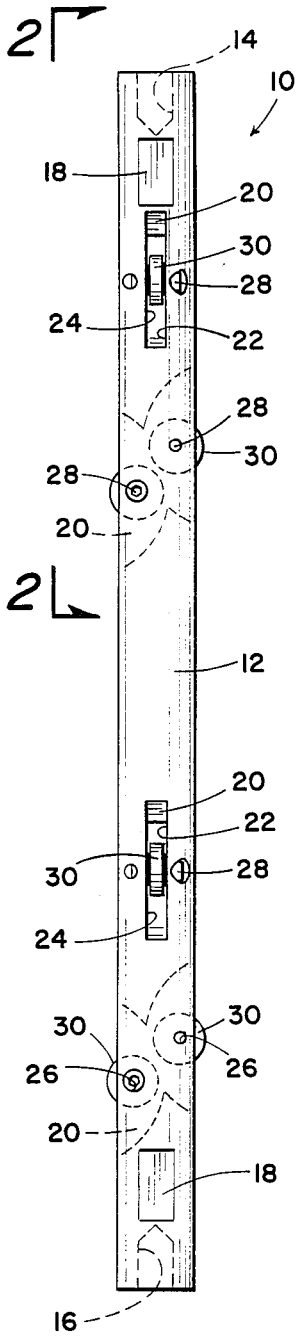
FIG. 1 is an external elevational view of an improved sucker rod guide of this invention.

Referring to the drawings and first to FIGS. 1 and 2, an embodyment of the invention is illustrated. The improved sucker rod guide is generally indicated by the numeral 10 and is formed of an elongated cylindrical member 12 having an external diameter less than the internal diameter of tubing in which it is to be used. Member 12 has an internal threaded recess 14 in the upper end and a co-axial internal threaded recess 16 in the lower end. The recesses 14 and 16 are designed to accept the male threaded ends of sucker rods (not shown) so that the member 12 may be inserted in and become part of a sucker rod string. Adjacent each the upper and lower ends is a wrench flat 18 configured to receive a wrench so that the device may be threaded onto a sucker rod string.

Formed in the member 12 are a plurality (four being shown in FIG. 1) of slots 20. Each of the slots 20 has parallel sidewalls extending from one opposed cylindrical sidewall to the other of the member 12, the side walls of each slot being designated by the numerals 22 and 24. The slots in FIGS. 1 and 2 are shown as cut by a cylindrical cutting member so that the top and bottom ends of the slots are not planar; however, each of the slots is formed so that it does extend completely through the member 12.

Intersecting each of the slots 20 are a pair of axle bores 26. Positioned in each of the bores 26 is an axle member 28 and received on each axle is a wheel 30. The wheels are free to rotate within the slots 20 between the sidewalls 22 and 24.

In the arrangement illustrated in FIG. 1 and 2 the boreholes 26 intersecting each slot 20 are slightly elevationally displaced from each other to allow use of larger diameter wheels 30 which will not interfere with each other.

When the device of FIGS. 1 and 2 is reciprocated as part of a sucker rod string in tubing each wheel 30, when contacting the tubing wall, will rotate. Each wheel 30 can engage the side wall of a tubing at only one place on its peripherial surface. At the same time, the arrangement insures that the wheels 30 are placed such that the guide external cylindrical surface will not engage the tubing interior but will be held away from the tubing interior by wheels 30. In like manner, since the sucker rod string is of substantially less external diameter than member 12, the sucker rods themselves will be held away from the wall of the tubing.

Figure 5:
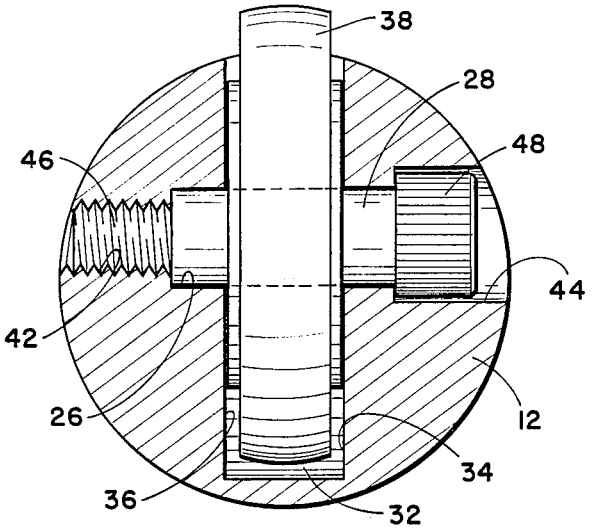
FIG. 5 is a cross-sectional view of the device of FIG. 3 showing one arrangement of a wheel and axel as employed in the invention.
Figure 4:
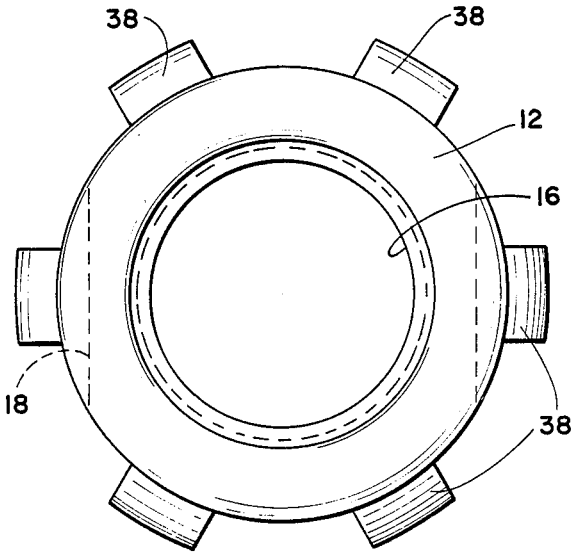
FIG. 4 is an end view of the second embodiment as taken along the 4—4 of FIG. 3.
Figure 3:
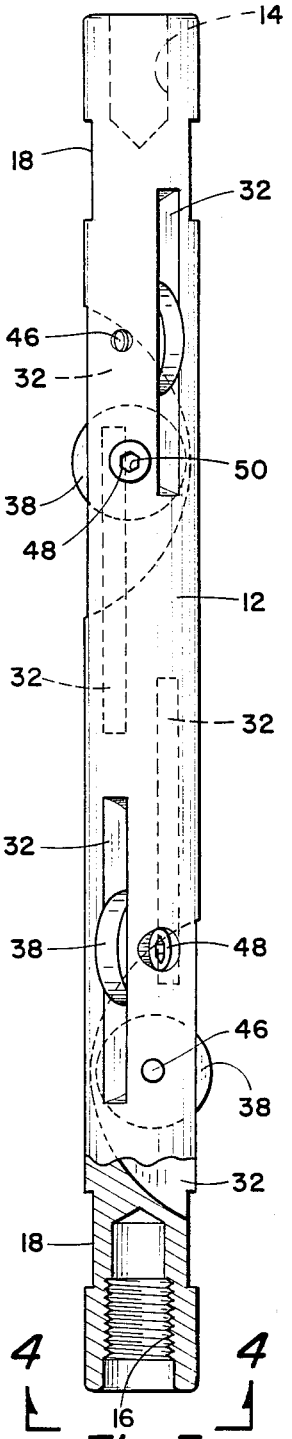
FIG. 3 is an elevational external view as in FIG. 1 showing an alternate embodiment of the invention.

FIGS. 3, 4 and 5 show a alternate embodyment of the invention which is designed for use with somewhat larger wheels. Member 12 is as previously described with reference to FIGS. 1 and 2; however, each slot 32 having opposed parallel side wall 34 and 36 does not extend entirely through the member 12 but, as illustrated, extends less than all the way through the member. Each slot 32 receives only one wheel 38 which may therefore be of a larger diameter. Each of the wheels 38 are received on an axle 40 as previously discussed with the planes of the slots being displaced from each other so that the wheels 38 extend beyond the member external circumferential surface to engage the wall of tubing to prevent the member from contacting the tubing FIG. 5 shows details of the arrangement of the axle bore 26 and axle 28. The bore 26 has a reduced diameter threaded portion 42 at one end and an enlarged diameter portion 44 at the other. The axle 28 in like manner has a reduced diameter threaded portion 46 and an enlarged head portion 48 which has an internal hex recess 50. The axles 28 are thereby retained in the axle bores 26 without any portion of the axles extending exteriorally of the surface of the member 12.

FIG. 4 shows an end view of FIG. 3 showing six wheels 38. In FIG. 3 only four wheels are illustrated although six slots 32 are shown, the two intermediate wheels are not shown to prevent the drawing from becoming over crowded although it is understood that they are received in the intermediate slots formed in the member 12.

The invention thus provides a sucker rod guide having the improved arrangement wherein the wheels can contact the peripherial internal surface of a tubing string only at one point and cannot therefore be subject, regardless of the reduction in the diameter of the internal cylindrical surface of the tubing to engage such surface at more than one point on the periphery of each wheel, as can occur in devices of the prior art.

While the invention has been described with a certain degree of particularity, it is manifest that many changes may be made in the details of construction and the arrangement of components without departing from the spirit and scope of this disclosure. It is understood that the invention is not limited to the exemplified embodyments set forth herein but is to be limited only by the scope of the attached claim or claims, including the full range of equivalency to which each element is entitled.

What is claimed is:

1. An improved guide for use in a string of sucker rods for reciprocation in a tubing string in a borehole, the sucker rods having threaded male ends, the guide comprising:

an elongated upright cylindrical member of external diameter less than the internal diameter of tubing in which it is to be used, the member having sucker rod receiving female threaded openings at the upper and lower ends, the threaded openings being coaxial of the member cylindrical axis whereby the member may be positioned in a string of sucker rods, and including a plurality of spaced-apart parallel sided slots within the member, each slot being of semi-circular configuration and of depth greater than the radius and less than the diameter of the cylindrical member, the sidewalls of each slot being parallel to and equally spaced from a plane of the member cylindrical axis;

the member having an axle bore therein for each of said slots, the axle bores being parallel and spaced apart from each other, a plane of the axis of each bore being perpendicular the member cylindrical axis and the axis of each bore being displaced away from the member cylindrical axis;

an axle received in each axle bore; and a wheel received on each said axle the diameter of each wheel being approximately the diameter of said cylindrical member, the periphery of each wheel extending beyond the member cylindrical wall whereby the wheels are positioned to engage and roll on the internal cylindrical surface of tubing, the planes of adjacent slots in said member being rotationally displaced from each other, a portion of each wheel extending beyond the cylindrical surface of said member, the opposed portion of each wheel being within the confines of said member cylindrical surface whereby each wheel can contact a tubing wall at only one point on its cylindrical surface.

2. A guide for use in a string of sucker rods according to claim 1 wherein said axle bores for each said slot are slightly elevationally displaced from each other.

* * * * *